US010920413B2

(12) United States Patent
Nicholas

(10) Patent No.: US 10,920,413 B2
(45) Date of Patent: Feb. 16, 2021

(54) PERGOLA BUILDING SYSTEM AND BRACKET

(71) Applicant: Stephen Nicholas, South Australia (AU)

(72) Inventor: Stephen Nicholas, South Australia (AU)

( * ) Notice: Subject to any disclaimer, the term of this patent is extended or adjusted under 35 U.S.C. 154(b) by 0 days.

(21) Appl. No.: 16/477,083

(22) PCT Filed: Aug. 15, 2017

(86) PCT No.: PCT/AU2017/050860
§ 371 (c)(1),
(2) Date: Jul. 10, 2019

(87) PCT Pub. No.: WO2018/129577
PCT Pub. Date: Jul. 19, 2018

(65) Prior Publication Data

US 2019/0330837 A1 Oct. 31, 2019

(30) Foreign Application Priority Data

Jan. 10, 2017 (AU) ..... 2017900054

(51) Int. Cl.

| | |
|---|---|
| ***E04B 1/343*** | (2006.01) |
| ***E04F 10/04*** | (2006.01) |
| *E04B 1/58* | (2006.01) |
| *E04B 2/78* | (2006.01) |
| *E04F 10/06* | (2006.01) |

(52) U.S. Cl.
CPC ..... *E04B 1/343* (2013.01); *E04F 10/04* (2013.01); *E04B 1/5825* (2013.01); *E04B 2/7818* (2013.01); *E04B 2001/5887* (2013.01); *E04F 10/0685* (2013.01)

(58) Field of Classification Search
CPC ..... E04B 1/343; E04B 1/5825; E04B 2/7818; E04F 10/04; E04F 10/0685; E04F 2001/5887
See application file for complete search history.

(56) References Cited

U.S. PATENT DOCUMENTS 4,458,461 A * 7/1984 Holley ..... E04B 2/7818 52/239
2008/0110127 A1* 5/2008 Terada ..... E04B 2/761 52/646

FOREIGN PATENT DOCUMENTS

AU 2010201674 A1 11/2010
CN 104790718 A 7/2015
(Continued)

OTHER PUBLICATIONS

International Search Report issued in connection with PCT/AU2017/050860.

(Continued)

*Primary Examiner* — Babajide A Demuren
(74) *Attorney, Agent, or Firm* — Akerman LLP

(57) ABSTRACT

A pergola system and bracket is described, which includes a frame having a plurality of vertical spaced apart posts, and horizontal frame members each of which have an internal reinforcing rod passing through at least a portion of the posts/frame members. The internal reinforcing rods are removably secured to a corner connecting element which then connects the posts/frame members to each other making it easier to construct and provides increased stability to the structure upon completion.

6 Claims, 12 Drawing Sheets

(56) References Cited

FOREIGN PATENT DOCUMENTS

| | | | | | |
|---|---|---|---|---|---|
| DE | 9216609 | U1 * | 2/1993 | ..... | E04H 12/2215 |
| DE | 29617093 | U1 * | 4/1997 | ..... | E04B 1/5825 |
| EP | 0834657 | A2 * | 4/1998 | ..... | E04B 1/5825 |
| WO | WO-2004088054 | A1 * | 10/2004 | ..... | E04H 17/1413 |
| WO | WO-2013132391 | A2 * | 9/2013 | ..... | E04B 1/24 |
| WO | 2015/104675 | A1 | 7/2015 | | |

OTHER PUBLICATIONS

Written Opinion of the International Searching Authority issued in connection with PCT/AU2017/050860.

* cited by examiner

PERGOLA BUILDING SYSTEM AND BRACKET

This application is a national phase of PCT/AU2017/050860, filed Aug. 15, 2017, and claims priority to AU 2017900054, filed Jan. 10, 2017, the entire contents of both of which are hereby incorporated by reference.

FIELD OF THE INVENTION

The present invention relates generally to building structures, and in particular to connectors for building structures.

BACKGROUND

Outdoor structures such as pergola or similar structures are particularly popular with those wishing to gain additional living or entertaining areas outside of their home. Pergola's and other similar structures, are useful in that they provide full or partial protection to the outdoor elements such as sun or rain and provide the opportunity for people to further their enjoyment outdoors.

Known pergola structures are typically constructed from wood and include a number of upright posts that are arranged about a rectangular area and subsequently covered by a roof which is formed by a rectangular grid, lattice or other roofing elements. The construction of such instructions typically requires 1st finding a suitable ground surface into which foundations are dug into which the heavy upright post is placed into and concrete poured around it in order to secure the post in its vertical position. In order to maintain the upright post in the vertical position during the curing of the concrete stabilises are attached and secured to the ground so that the upright post does not inadvertently lean over. If this occurs and is not noticed in time the whole of the structure can be compromised, not to mention affecting the aesthetics of the structure.

Assuming that the upright posts are installed correctly, the wooden frame members have to then be lifted or hoisted into place, typically requiring a number of people to do so. The wooden frame members are then held in place by a number of brackets that are either screwed or nailed into the upright posts. Cross-rails or lattice beams are then secured to the wooden frame members onto which is attached sheet roofing material.

The types of structures described above present number of problems such as the complexity of construction as well as requiring a degree of skill and confidence in the correct installation and assembly. In addition, several people are required to construct such instructions due to the nature of the materials being used.

In addition, the types of structures described above are often lacking in strength, as the elements are not connected to one another in a manner that results in an inherently strong structure. Often the upright posts are provided without any form of bracing apart from the foundations into which they are inserted and the coupling brackets that are nailed to them. Other pergola structures utilise lap joints, however, in each case there is little tying the elements together and as there can be a number of joints over the entire structure, all of which are exposed both to weather and associated stress, this results in their being several points of weakness across the entire structure.

As such, the construction of such structures is often beyond the capability of skill set of the typical homeowner and therefore they are required to hire skilled labour in order to complete the task.

SUMMARY OF THE INVENTION

According to the present invention there is provided a pergola system, including a frame having a plurality of substantially vertical spaced apart posts, each having an upper and lower face, at least one substantially horizontal frame member, the at least one substantially horizontal frame member having a longitudinal length, with opposing end faces and an internal reinforcing rod located therein, the internal reinforcing rod being configured to be removably secured with at least one corner connecting element/bracket, the at least one corner connecting element/bracket having a plurality of vertical side faces, with at least one slot thereon for receiving a connection means there through and a horizontal bottom face with at least one opening, for receiving a connection means there through.

In preference, the internal reinforcing rod extends the longitudinal length of the at least one substantially horizontal frame member.

In preference, the internal reinforcing rod is removably secured to the corner connecting element by way of screw threaded bolts.

In preference, the internal reinforcing rod has an internal threaded section at a first end and a second end to threadingly engage with the screw threaded bolts.

In preference, the at least one slot is U-shaped.

In preference, the corner connecting element has at least four vertical side faces.

In preference, the corner connecting element has two vertical side faces.

In preference, the plurality of vertical posts include internal reinforcing rods.

In preference, the internal reinforcing rods in the vertical posits are configured to be removably secured via the bottom face of the at least one corner connecting element.

In preference, the system includes an upper connecting adaptor shaped to receive at least a portion of the corner connecting element therein.

In preference, the upper connecting adaptor has at least four vertical sides and a bottom face.

In preference the upper connecting adaptor has an internal shape to receive the corner connector therein.

In preference, the upper connecting adaptor includes at least one downward projecting lug on a bottom face.

In preference, the at least one downward projecting lug is offset to a central axis of the upper connecting adaptor.

In preference, the at least one downward projecting lug nests within an opening located on the upper face of the substantially vertical spaced apart post.

In preference, the corner connecting element is used in the construction of a pergola having a plurality of vertical posts.

In preference, the pergola system includes a top plate shaped to fit within the corner connecting element.

In preference, the top plate has at least one downwardly projecting flange projecting from a bottom surface.

In preference, the at least one downwardly projecting flange is shaped to fit within the at least one slot of the corner connecting element.

In preference, the top plate has an aperture there through for receiving a fastening member, such as a bolt.

In preference, the top plate fits within the corner connecting element and the at least one downwardly projecting flange projecting from a bottom surface aligns with the at least one slot and upon fastening the fastening member secures a portion of the internal reinforcing rod between the top plate and the corner connecting element.

In preference, the fastening member secures a portion of the internal reinforcing rod between the top plate and the corner-connecting element by clamping the internal reinforcing rod between the top plate and the corner connecting element.

In preference, the pergola system is free standing.

A corner connecting system when used to construct a structure, the system including

- at least one corner connecting element/bracket having a plurality of vertical side faces, with at least one slot thereon for receiving a connection means there through and a horizontal bottom face with at least one opening for receiving a connection means there through,
- a post having a reinforcing rod passing there through and at least one opening or recesses on an end face and,
- a post adaptor, the post adaptor having an underside with at least one downwardly projecting lug shaped to nest within the at least one opening or recesses on an end face of the post; the post adaptor having a recess or opening shaped to couple with the at least one corner connecting element/bracket,
- a fastening means adapted to be removably secured to the reinforcing rod, to fasten the corner connecting element/bracket to the post adaptor and to the post.

A further embodiment of the present invention resides in the method of assembly of the described pergola system.

BRIEF DESCRIPTION OF THE DRAWINGS

By way of example only, an embodiment of the present invention is described more fully hereafter with reference to the accompany drawings in which.

DESCRIPTION OF THE INVENTION

Figure 1:
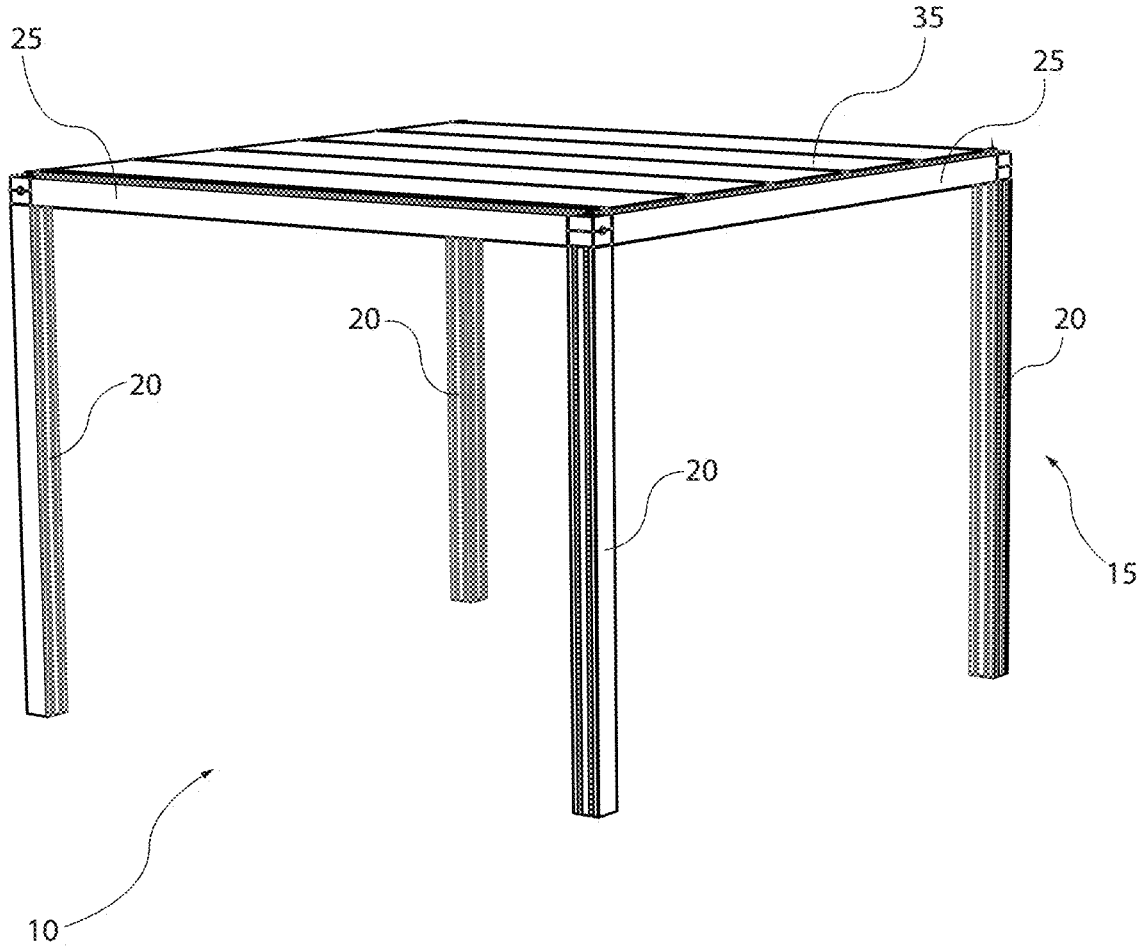
FIG. 1 is an isometric view of an exemplary pergola structure.
Figure 2:
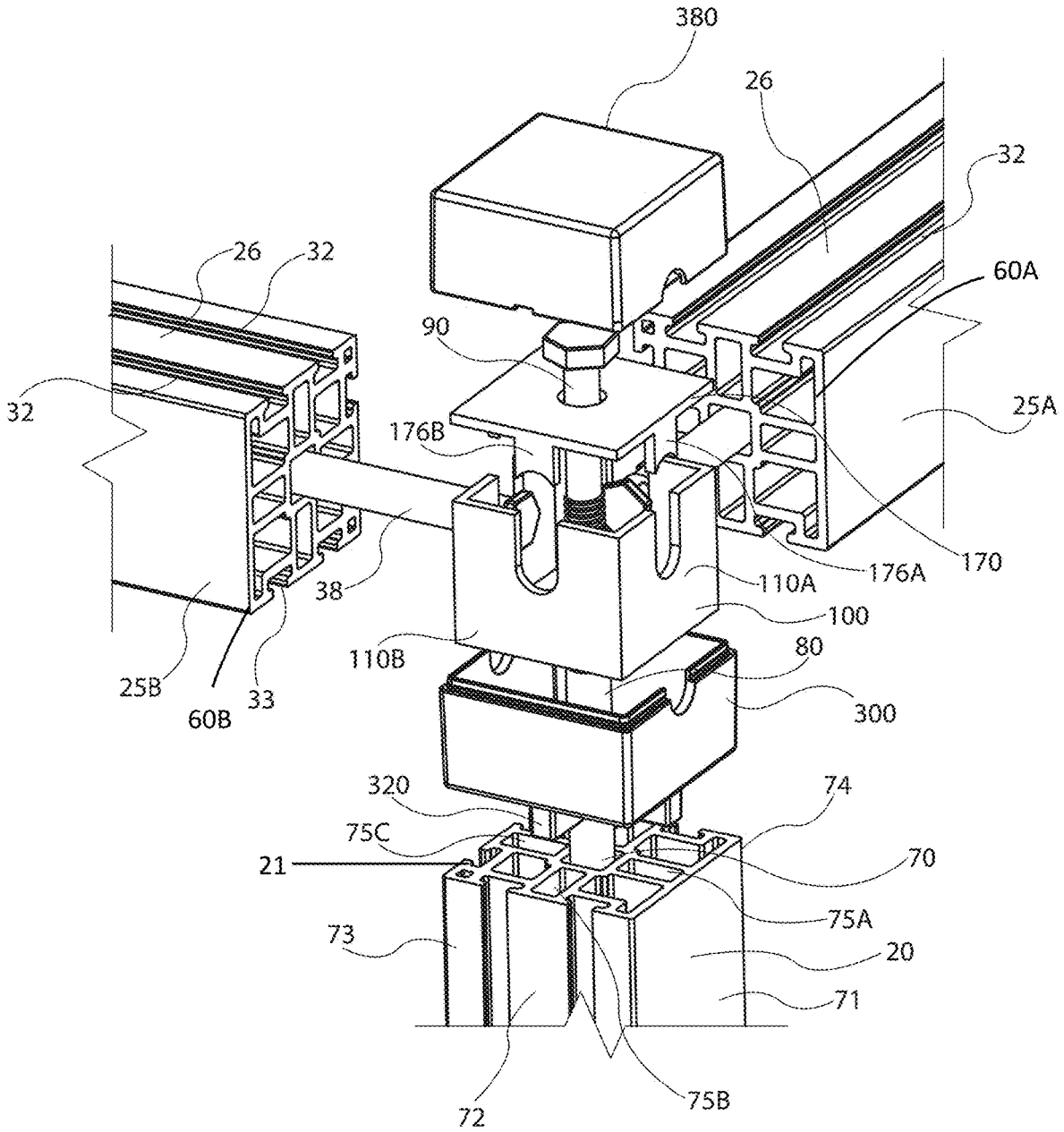
FIG. 2 is an exploded isometric view of the exemplary pergola structure, showing the corner connecting element/bracket and connecting frame members and post.
Figure 2A:
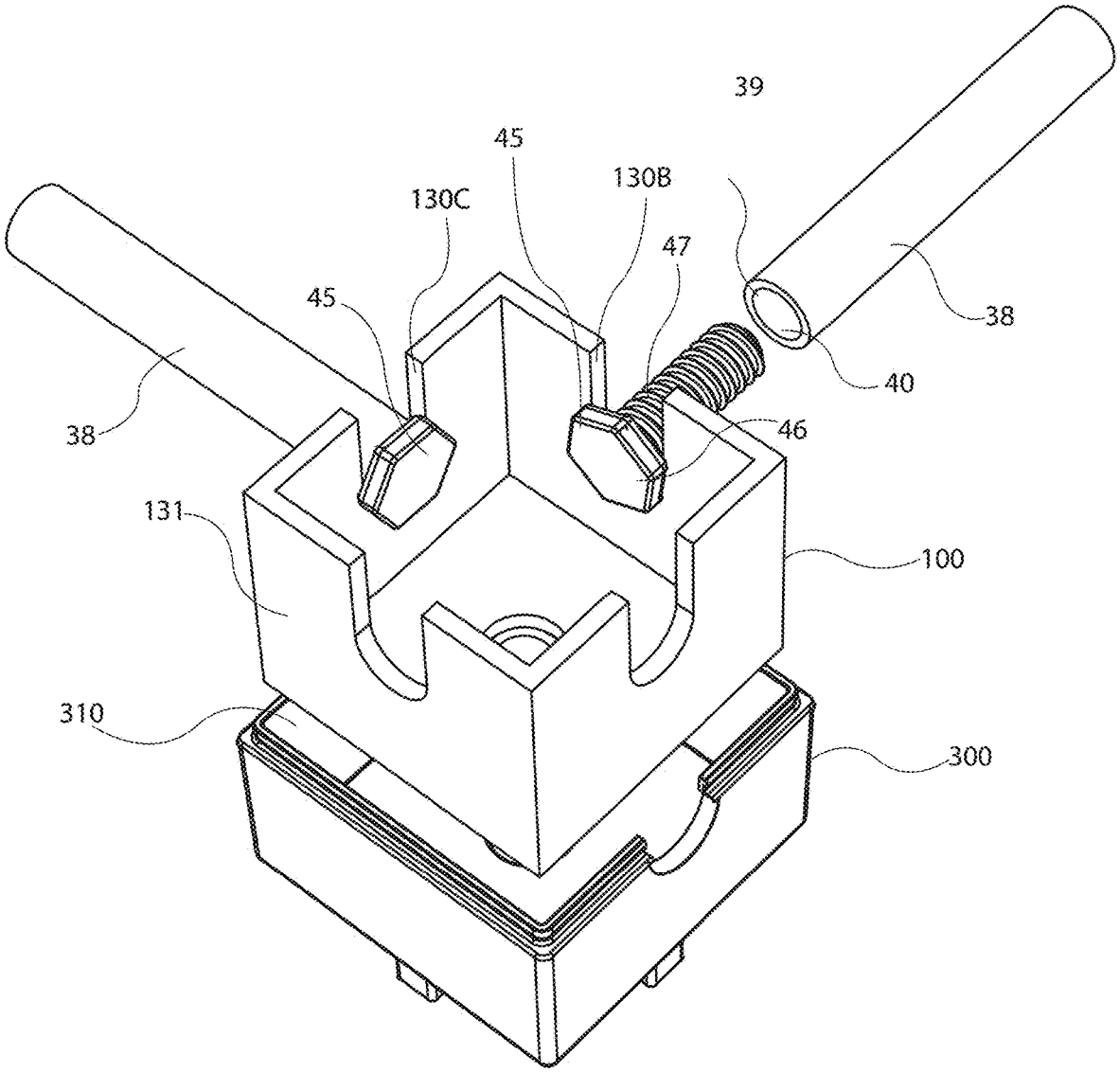
FIG. 2A is an upper perspective view of FIG. 2 with the top piece and upper cover removed to show the inside of the corner connecting element.
Figure 2B:
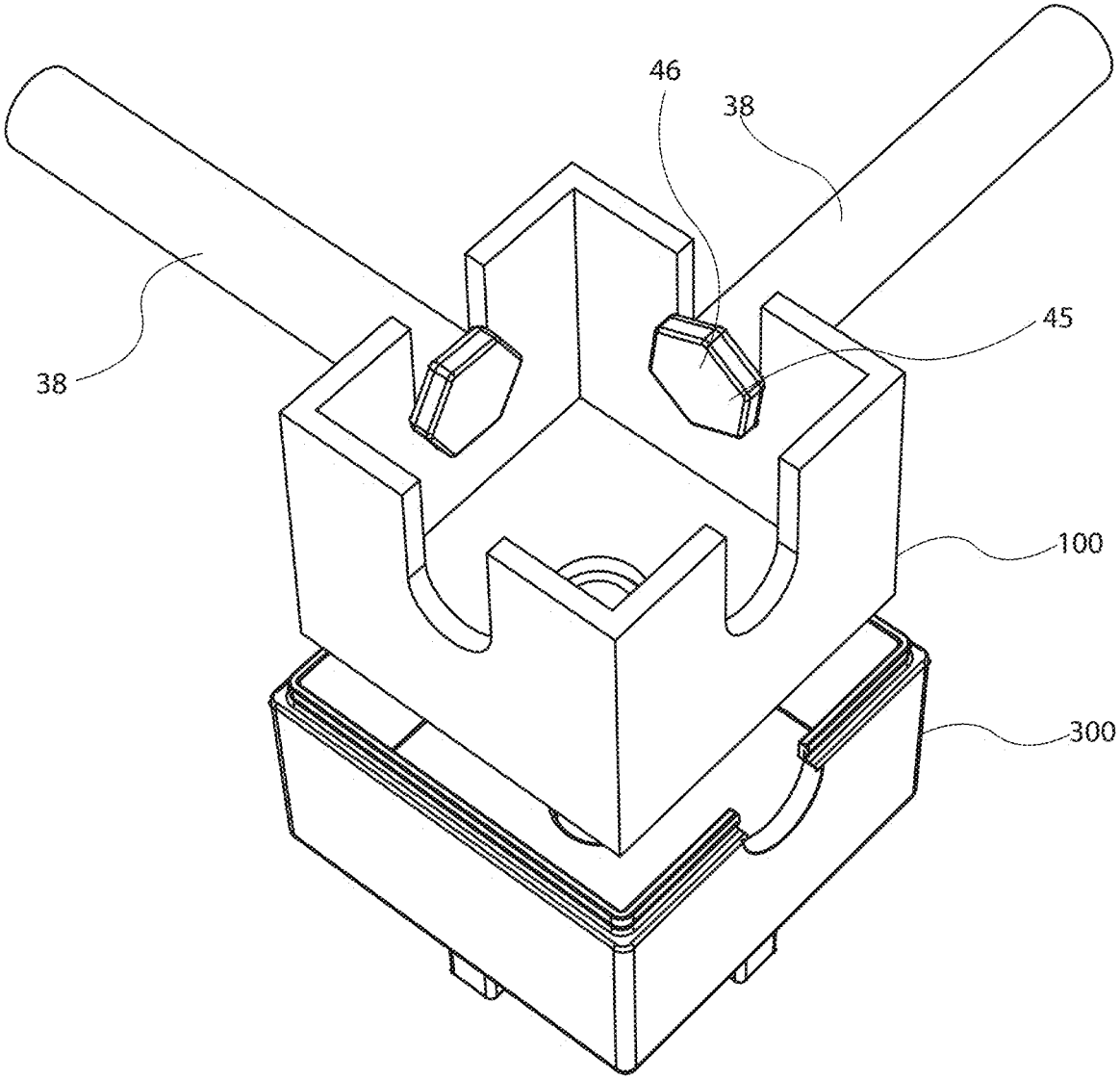
FIG. 2B is the view of FIG. 2A with the bolt fastened.
Figure 2C:
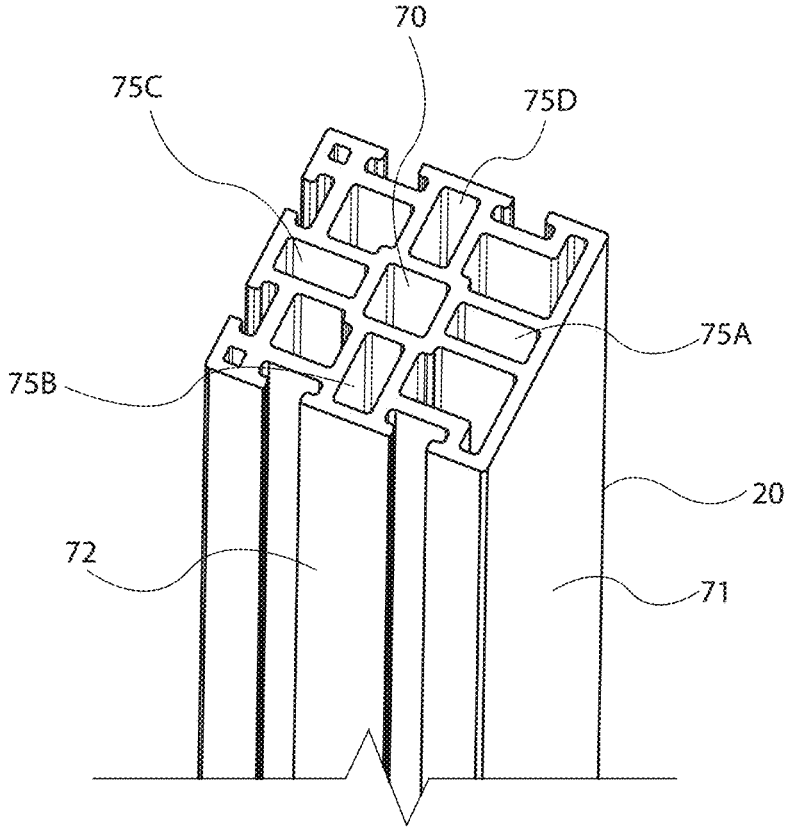
FIG. 2C is a perspective view of the vertical frame member extrusion.
Figure 3:
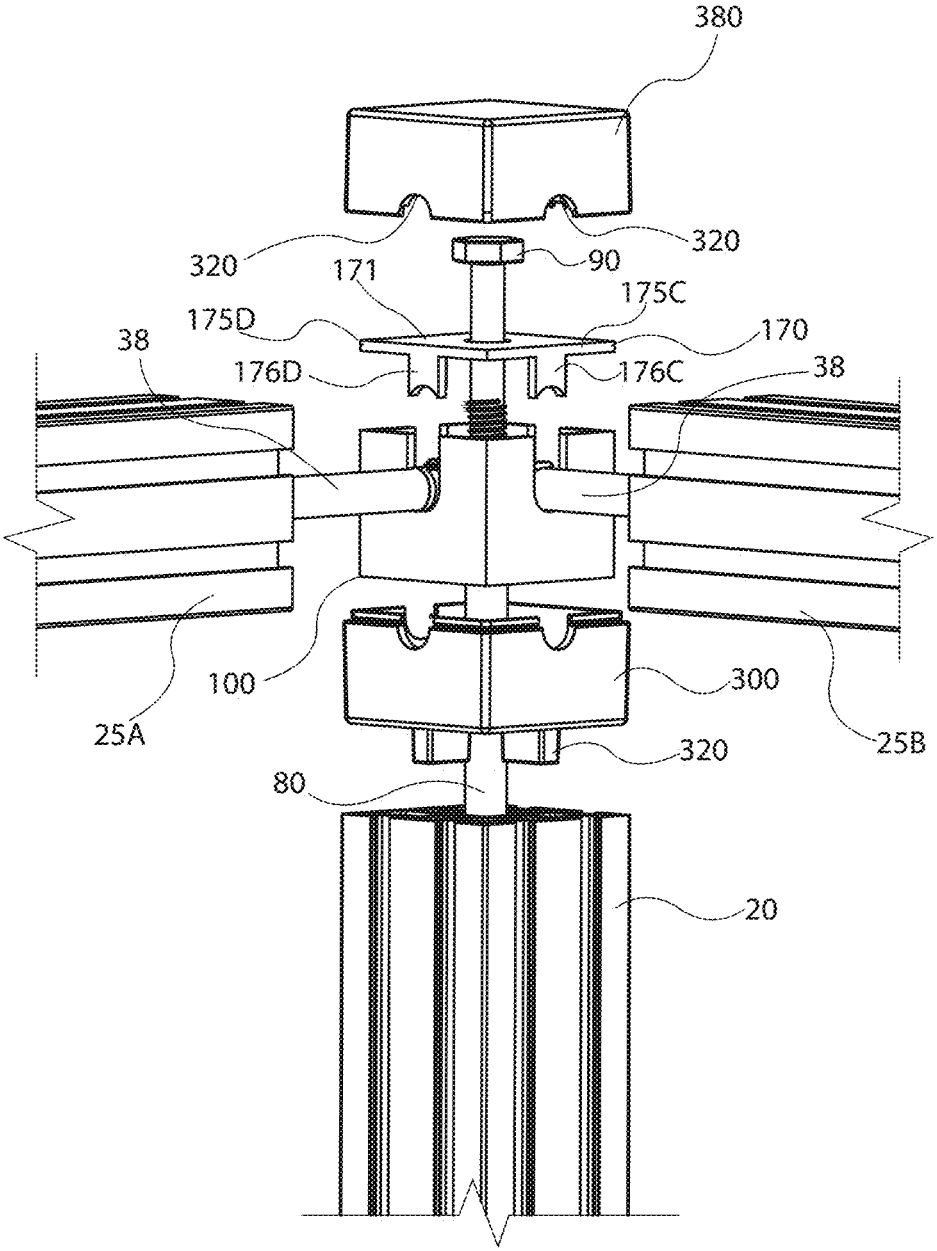
FIG. 3 is a further isometric view of FIG. 2.
Figure 4:
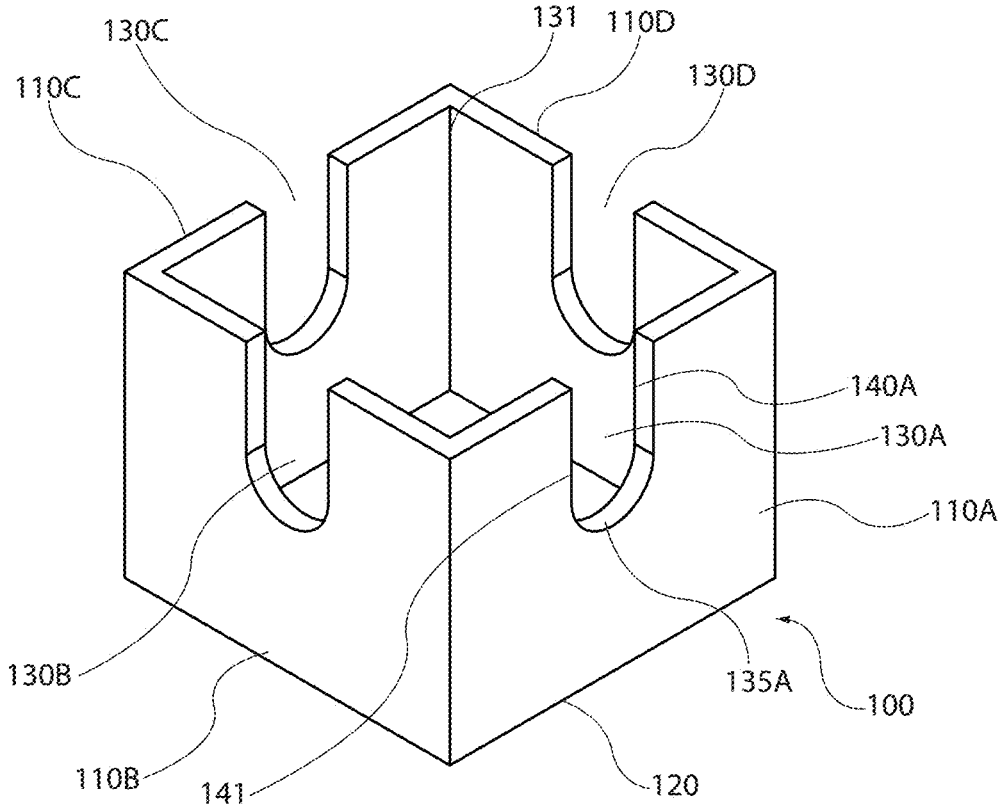
FIG. 4 is an isometric view of the corner connecting element shown in in FIG. 2.
Figure 5:
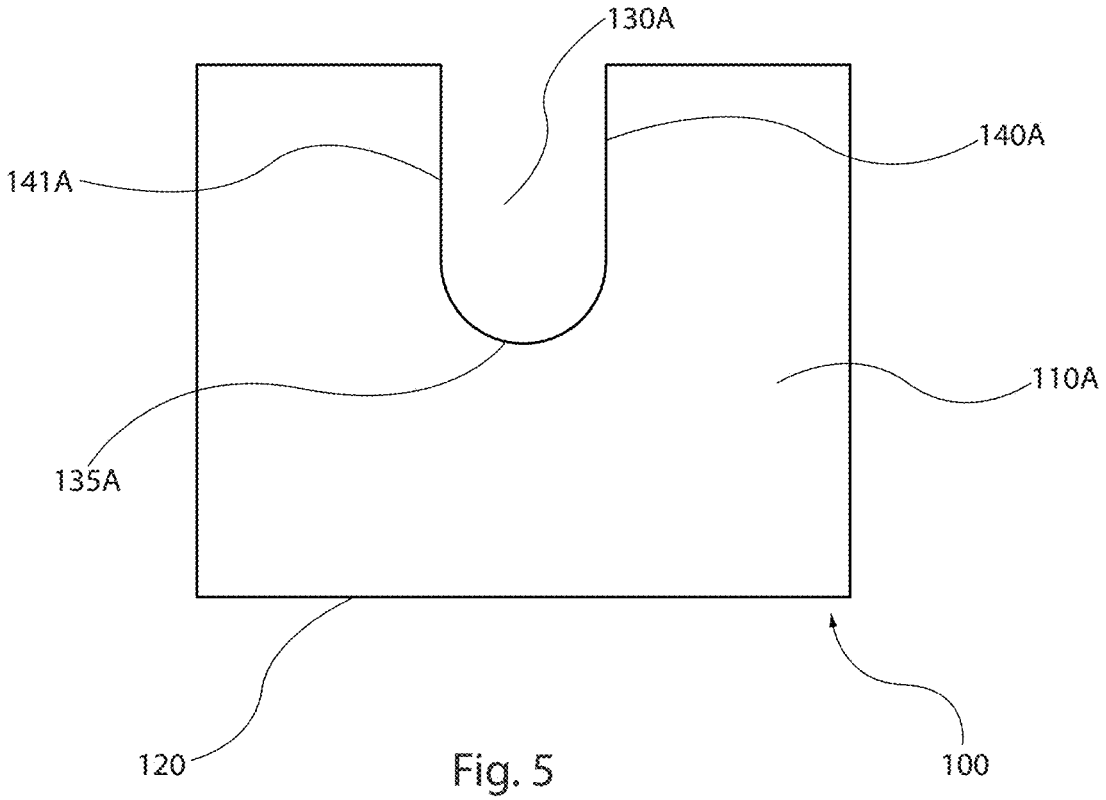
FIG. 5 is a side view of the corner connecting element shown in FIG. 4.
Figure 6:
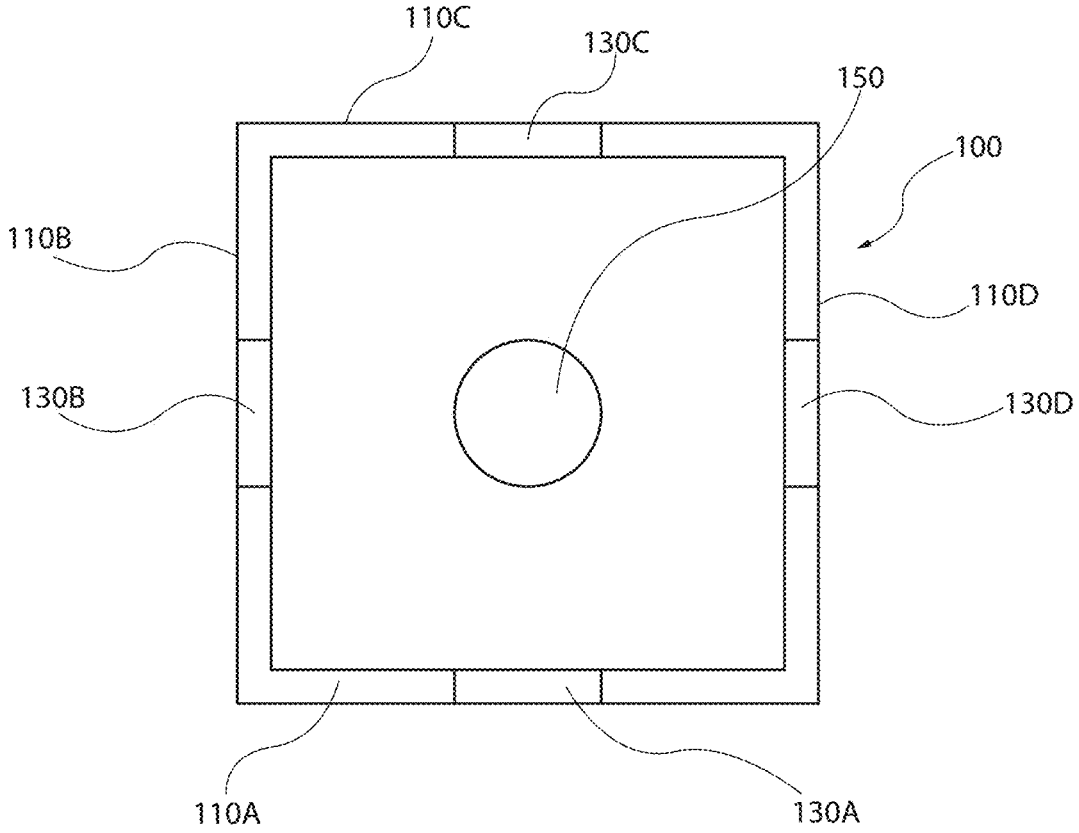
FIG. 6 is a top view of the corner connecting element show in FIG. 4.
Figure 7:
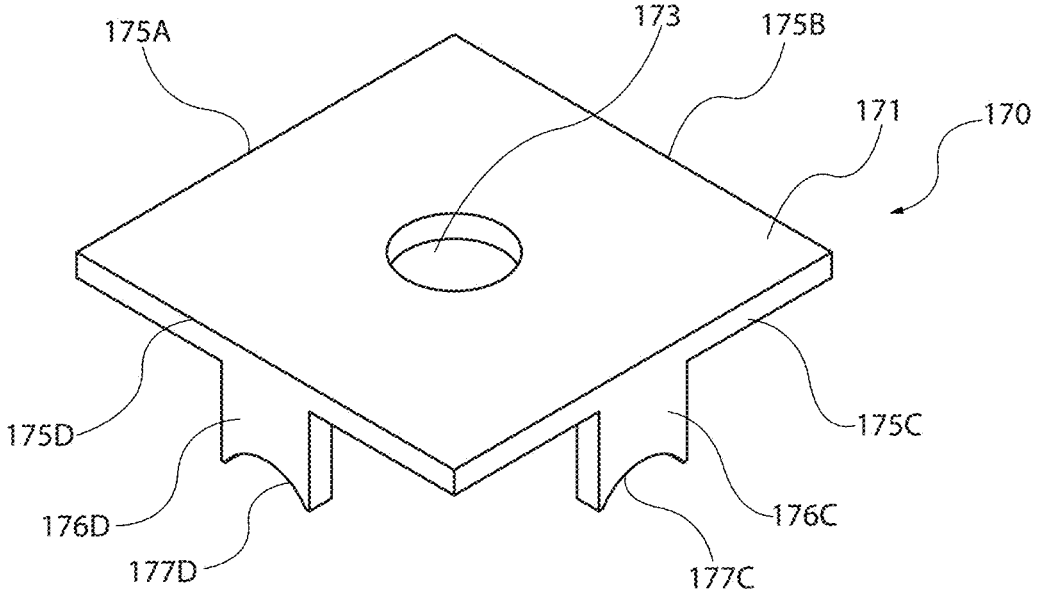
FIG. 7 is a perspective view of the top cap of the corner connecting element.
Figure 8:
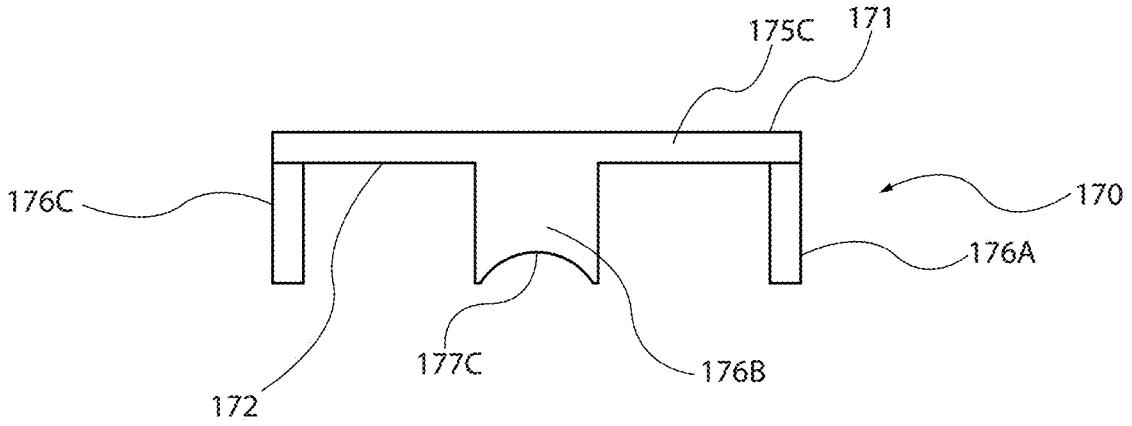
FIG. 8 is a side view of the corner connecting element of FIG. 7.
Figure 9:
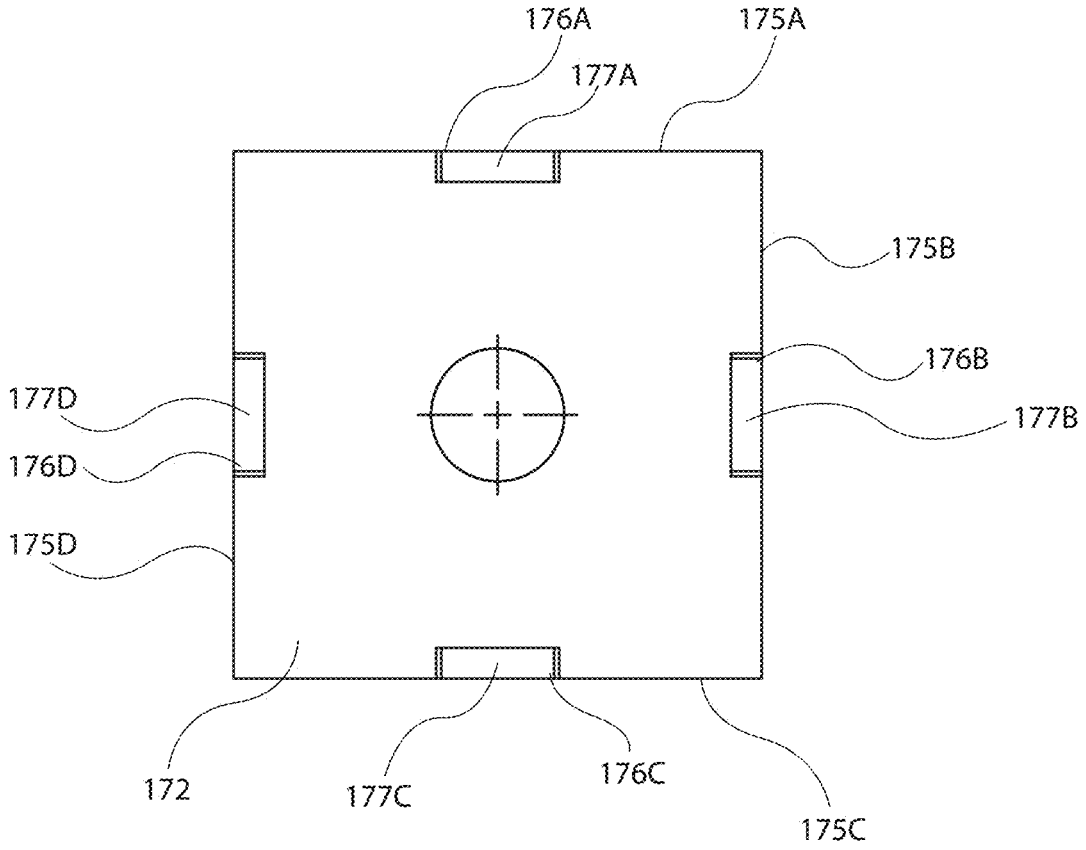
FIG. 9 is a bottom view of the corner connecting element of FIG. 7.
Figure 10:
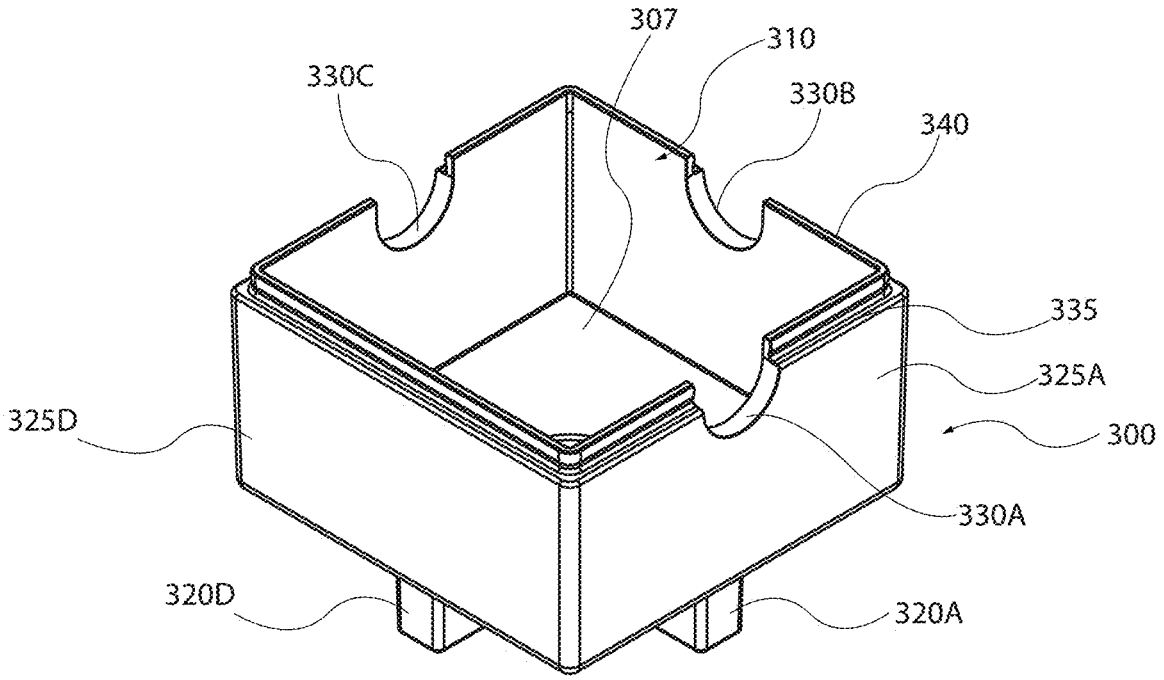
FIG. 10 is an isometric view of the upper connecting adaptor.
Figure 11:
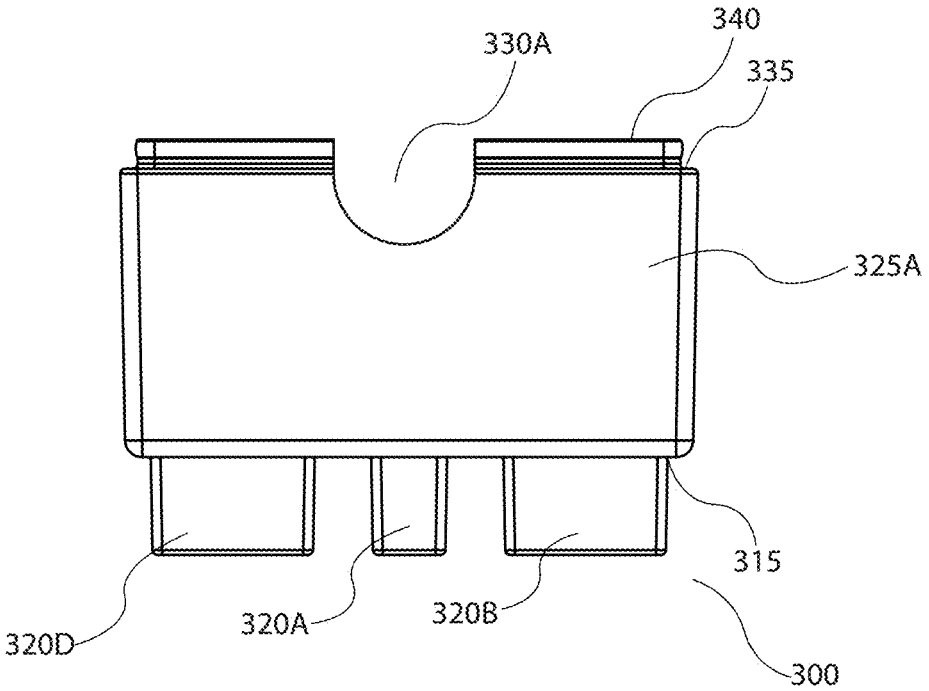
FIG. 11 is a side view of the upper connecting adaptor of FIG. 10.
Figure 12:
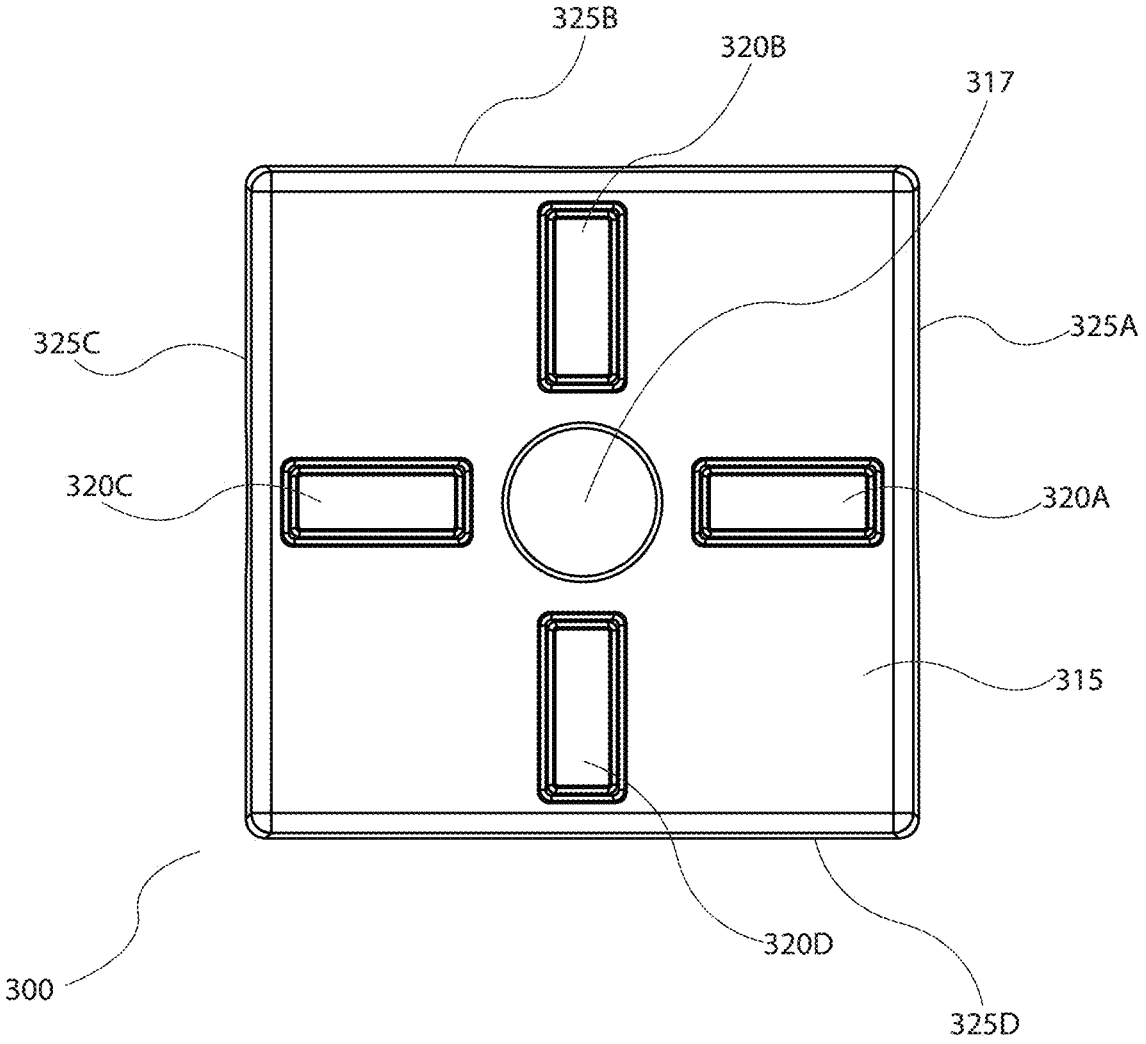
FIG. 12 is a bottom side view of the upper connecting adaptor of FIG. 10.
Figure 13:
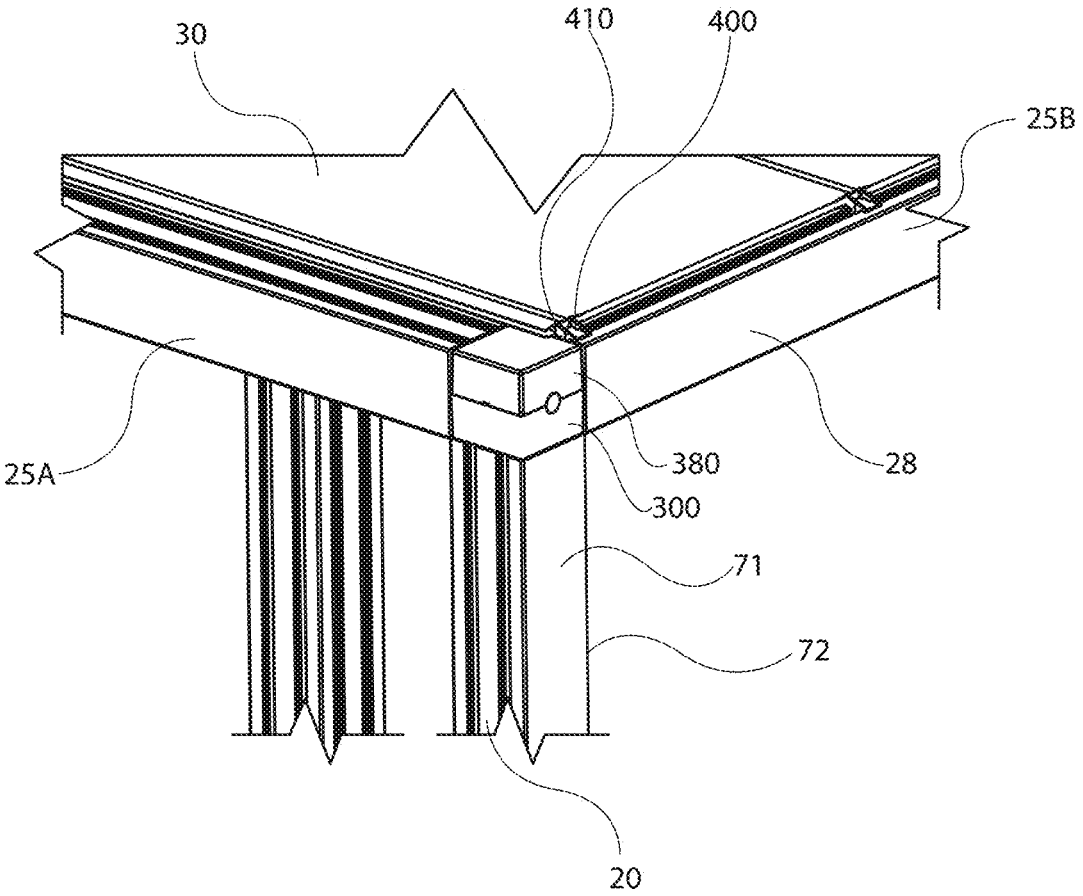
FIG. 13 is the assembled isometric view of FIG. 2.

The general arrangement of a freestanding pergola framing system 10 is shown in FIG. 1, according to an embodiment of the present invention.

As shown in FIG. 1, the freestanding frame system 10 includes a frame 15 having a plurality of generally vertically orientated spaced apart posts 20 aligned in a suitable manner, such as that shown in FIG. 1. Generally horizontal frame members 25 are attached or connected to the posts 20 in a manner that will be discussed in more detail below. Preferably the frame members 25 are connected at right angles to the posts 20 and extending between the frame members 25 is a plurality of panel sections 30. The frame members 25 and vertical posts 20 are substantially similar in design being differentiated by the numbers 20 and 25 so as to differentiate their respective orientation. As will be clear from the description and the drawings the 20 and 25 differ only in their orientation.

The roof panel sections 30 interlock with an edge or face of the frame members 25 so as to provide an interlocking structure.

Each frame member 25 has a channel 32 on a top face 26 and channel 33 on its bottom face 27. Other channels may be present on the side faces 28 and 29 respectively as required. Through the centre of the frame members 25 is a hollow section 35 spanning the entire length of the frame member 25 into which can be inserted a reinforcing rod 38. The reinforcing rod 38 is the core of the frame member 25.

In a preferred embodiment the frame member 25 and posts 20 can be made from a suitably lightweight material such as plastics or aluminium in order to take advantage of their lightweight and ease of manufacture by known extrusion technologies. The internal reinforcing rods 38 can be constructed from a high-grade aluminium or steel as required so as to reinforce the strength of the frame members or posts that they are inserted into.

The reinforcing rods 38 are inserted into the hollow section 35 of the frame members 25, the reinforcing rod 38 having an internal thread 40 into which a bolt 10 threadingly engage with. For example, a bolt 45 can be threaded into the reinforcing rod 38 partially so as to leave a section of the bolt shank 47 showing. The distance between the bolt head 46 and the outer face 39 of the reinforcing rod 38 is sufficient to allow the bolt shank 47 to pass into the U shaped slot 130 of the corner connecting element/bracket 100. Thereafter the same process can be repeated for frame member 25A-D and each of the bolts 45 can be tightened thus drawing the end faces 60 of the frame member 25 into contact with the side face 110 of the corner connecting element 100. In order to achieve this the reinforcing rod 38 has a length that is slightly less than the length of the frame member 25 into which it is inserted into.

In an alternative embodiment, the reinforcing rod 38 may be sectioned so that there are two sections of reinforcing rod inserted into the frame member 25, one left hand section and one right hand section, which may only travel part way along the length of the frame member 25.

By repeating this process with the remaining frame members a complete frame can be readily constructed without the need for any particular construction skill and in relatively short time.

Each of the substantially vertical posts 20 also contain a hollow section 70, which defines a central axis of the vertical post 20, and has sides 71-74 although other shapes are considered to fall within the scope of the invention, and an end face 21 at the longitudinal end. The opposite end face of the post is not shown.

As with the frame members 25, a reinforcing rod 80 is inserted into the hollow section 35 of the post 20 so as to increase the structural integrity of the post 20. The corner connecting element 100, having an aperture 150 on its lower or bottom face 120 can be fastened to the reinforcing rod 80 by insertion of the fastening means being the bolt 90 through aperture 150 to threadably engage with the reinforcing rod 80, which has an internal thread.

In order to facilitate the connection between the corner connector element/bracket 100 and the post 20 an additional connecting element can be utilised, such as the upper connecting adapter/post adaptor element 300 is suitably shaped so as to nestingly receive or couple the corner connection element 100 within. In the embodiment shown the upper connecting adapter 300 is substantially square having faces 325 A-D and a void or recess/cavity 310 into which the corner connector element can 110 nest within. On the inner bottom face 307 is an opening 317, though which a reinforcing rod 80 can pass through.

On the lower face 315 of the upper connecting adapter 300 are the projecting lugs 320A-D shaped to fit within matching recess or openings 75A-D of the post 20 or frame so as to secure the corner connecting element square and in line with the upright post 20. In the form of the upper connecting adaptor 300 as shown there are a number of lugs 320 however in some instances there may only be one lug or any number of lugs as desired or needed to mate or nest within a matching opening or recess in a face of the post. The upper connecting adapter 300 further has the curved notches 330A-C located on the upper periphery of the edge 335, substantially in line with the related projecting lugs 320A-C. Note that face 325D does not have any curved notches as found on faces 325A-C, as face 325D can provide a clean aesthetic look when used to support three frame members. Other configurations of curved notches are possible from 1-4 depending on requirements and final shape of the upper connecting element 300, as well providing for different shapes of notches when different shaped rods are utilized, for example square tubular rods would nest with square shaped notches.

About the upper periphery rim 335 is a flange 340 shaped to fit complimentary with a flange on an upper cover 380 to assist in location and orientation of the two parts.

The upper cover 380 is shaped complimentary to the corner connecting element 100 and the upper connecting adapter 300 in that they are all square shaped. The upper cover 380 further includes a number of curved notches 382 shaped to rest against an outer surface of the rods 38.

In a further embodiment of the invention, the corner connecting element 100 may incorporate a downward projection from its lower or bottom face 120 which would then nest within the opening 75 of the post 20 so as to avoid the need to use an upper connecting adapter. The upper connecting adapter 300 does however provide a way of at least partially concealing the corner connecting element 100 from view and by including the upper cover 380, which can be placed over the top of the corner connecting element 100, is possible to then fully conceal the corner connecting element 100 in the completed construction constructed frame.

In order to securely removably attached the roof sections 30 to the frame 15, roof panel adapters 400 slidingly engage with the slot or channel 32 on the top face 26 of the frame member 25. The roof panels 30 can then slide in between the top face 26 of the frame member 25 and the projecting flange 410. In the embodiment as shown a pair of roof sections 30 can be held in place by a pair of roof panel adapters 400, the being on positioned on the opposite frame member. Once a pair of panels 30 are in place then an additional roof panel adapter here 400 can be inserted into the channel 32 followed by an additional pair of roof sections until sufficient roof surface is formed as desired. This allows then for customization of the roof surface to the specific requirements of the installer, or the modification of the roof surface as might be required by change of season or aesthetic requirements without the use of additional tools or expertise.

In more detail, the corner connecting element 100, according to one embodiment, has a plurality of side faces 110 A-D to form a generally square shape element with a bottom face 120. The interior of the corner connecting element 100 has a void 131, which is defined by the bottom face 120 and the side faces 110 A-D. Each of the side faces 110 A-D includes a U-shaped slot 130 A-D, each of which is in line with a slot on an opposing face. For example, slot 135A is in line with slot 135C on the opposing side face 110C. The slots 130 have substantially parallel sides 140A and 141A respectively and terminate in a curved ending section 135. In the embodiment shown in the figures the sides 140 and 141 are substantially perpendicular however other angles are considered to fall within the scope of the invention, for example where the sides 140 and 141 are inclined with respect to one another.

The curved section 135 may be configured in an alternative geometry, for example a flat ending, as required. Positioned on the bottom face 120 is a main aperture 150 substantially in the middle of the corner connecting element 100. Opening may be located close to the right angled interface in the void area 131 between the inside side faces 110 A-D for receiving fastening elements, such as screws or bolts in order to assist in the fixing of the corner connecting element to an appropriate structure or surface.

The top plate 170 sits in coaxial alignment with the upper connecting element 300 and the corner connecting element 100. The top plate 170 as the upper surface 171 and lower surface 172. An opening 173 is located substantially in the middle of the other surface 171 to allow passage of a bolt 90 to pass through it. Located on the sides 175 A-D of the top plate 170 are downwardly extending flange elements 176 A-D each of which terminate in a concave face 177 A-D, the shape of which is such that it substantially matches the outer diameter of the rod 38. When the top plate 170 is inserted over the top of the corner connecting element 100, the flanges 176 A-B line up substantially with the voids on 130 *a*-B, which are the U-shaped slots. When a rod 38 is inserted into the U shaped slot 130, the top plate 170 is then aligned with the corner connecting element 100 and inserted into the void 131 where the flanges 176 A-D then lineup with the slots 130 and the top plate 170 is then brought into contact with the corner connecting element 100 and the flanges 176 A-D then slide into the mutually aligned slot 130 A-D where the concave end 178 of the flanges 176 then rests against an outer surface of the respective board 38.

The bolt 90 is then inserted into the opening 173 of the upper surface 171 and fastened into position by threaded engagement to the rod 80 that it is coaxially aligned with. Tightening of the bolt 90 then draws the top plate 170 closer to the coroner connecting element 100 wherein the flanges 176 A-D urge against the respectively positioned rod 38 and securely clamp it into position. This then has the effect of further holding the corner element assembly and the respective rods in place with one another as well as to their respective frame elements.

As shown in the figures, only to rods are inserted into the corner connecting element 100, but as would be appreciated by those schooled in this art, additional rods may be inserted into the remaining unoccupied slots 130 and secured in the manner as described herein. This would then allow the corner connecting element 100 to act as a central connecting element with frame element extending In an alternative embodiment of the present invention, the corner connecting element 200 is substantially cubed shaped having the side faces 210 A-D and the bottom face 220. The side faces 210A and 210D are triangular in shape having an edges 225A and 225B that slopes downwards towards the bottom face 220. Side faces 210B and 210C have U-shaped slots 240 orthogonal to one another. The bottom face 220 has an opening 240 through it to receive a bolt.

As the corner connecting element 100 can primarily to be located in the corner position of any structure then it will require at least two U-shaped slots. By having four U-shaped slots, as shown corner connector 100, the versatility of the connecting element is greatly enhanced as it allows for it to be used in line as well as for right angled connections.

In other embodiments, the corner connecting element can have a single U-shaped slot on one of its side faces where there is no need for additional frame connection points.

In yet further embodiments, the corner connecting element may be multi-sided, such as hexagonal or pentagonal, each side have a U-shaped as required to allow for construction of more complicated structures.

By connecting each of the frame elements to a corner connecting element by way of the reinforcing rods the entire structure will be cohesively and integrally connected. The reinforcing rods through the frame members proving the required tensile strength that is otherwise lacking from traditional pergola systems that rely on either surface brackets or lap joints. The connection of the reinforcing rods is readily achieved by way of tightening the bolts in the corner connection members using readily available tools. The same corner connection elements/bracket and upper connecting element can also be used at a ground level of the vertical post to secure the vertical post at a lower ground level. As will then immediately be clear to those skilled in the art, this then results in a frame that is secured integrally on all corners providing an enhanced level of connection and overall strength.

The resulting pergola frame being relatively lightweight due to the outer frame member being made from a plastics or aluminum material which allows it to be easily moved and lifted as required. The interconnection of the frame elements of the pergola system also allows for the simply insertion of roofing elements as required, no special fastening tools needed.

As is now apparent, the present system and components allow for the quick and efficient construction of a pergola frame without requiring specialist skills.

What is claimed is:

1. A pergola system, including a frame having a plurality of substantially vertical spaced apart posts, each having an upper and lower face, at least one substantially horizontal frame member, the at least one substantially horizontal frame member having a longitudinal length, with opposing end faces and an internal reinforcing rod located therein, the internal reinforcing rod being configured to be removably secured with at least one corner connecting element, the at least one corner connecting element having a plurality of vertical side faces, with at least one slot thereon for receiving a connection means there through and a horizontal bottom face with at least one opening, for receiving a connection means there through, wherein the internal reinforcing rod extends the longitudinal length of the at least one substantially horizontal frame member;

wherein the internal reinforcing rod is removably secured to the corner connecting element by way of screw threaded bolts;

wherein the corner connecting element has at least four vertical side faces;

wherein the plurality of vertical posts include internal reinforcing rods;

wherein the internal reinforcing rods in the vertical posts are configured to be removably secured via the bottom face of the at least one corner connecting element;

wherein the system further includes an upper connecting adaptor shaped to receive at least a portion of the corner connecting element therein;

wherein the upper connecting adaptor has an internal shape to receive the corner connecting element therein;

wherein the upper connecting adaptor includes at least one downward projecting lug on a bottom face; and wherein the at least one downward projecting lug is offset to a central axis of the upper connecting adaptor and nests within an opening located on the upper face of the substantially vertical spaced apart post.

2. The pergola system of claim 1, further including a top plate shaped to fit within the corner connecting element, the top plate having at least one downwardly projecting flange projecting from a bottom surface and the at least one downwardly projecting flange is shaped to fit within the at least one slot of the corner connecting element.

3. The pergola system of claim 2, wherein top plate has an aperture there through for receiving a fastening member.

4. The pergola system of claim 3, wherein the fastening member is a bolt.

5. The pergola system of claim 3, wherein the top plate fits within the corner connecting element and the at least one downwardly projecting flange projecting from a bottom surface aligns with the at least one slot and upon fastening the fastening member secures a portion of the internal reinforcing rod between the top plate and the corner connecting element.

6. The pergola system of claim 4, wherein the corner connecting element is used in the construction of a pergola having a plurality of vertical posts.

* * * * *